United States Patent [19]

Troue

[11] 3,936,950

[45] Feb. 10, 1976

[54] METHOD OF INERTING THE ATMOSPHERE ABOVE A MOVING PRODUCT

[75] Inventor: Harden Henry Troue, Plainfield, Ind.

[73] Assignee: Union Carbide Corporation, New York, N.Y.

[22] Filed: Apr. 16, 1974

[21] Appl. No.: 461,398

[52] U.S. Cl. ..... 34/4; 34/41; 204/159.23; 250/492 R

[51] Int. Cl.[2] ..... B01K 5/00

[58] Field of Search ..... 34/23, 33, 34, 36, 4, 41, 34/155, 160, 1; 250/453, 432, 455, 492; 117/93, 93.3, 93.31; 204/159.11, 159.23

[56] References Cited

UNITED STATES PATENTS

| | | | |
|---|---|---|---|
| 2,060,430 | 11/1936 | Spooner | 34/23 |
| 2,887,584 | 5/1969 | Nygard | 250/49.5 |
| 3,448,526 | 6/1969 | Smith, Jr. | 34/4 |
| 3,676,673 | 7/1972 | Coleman | 250/398 |
| 3,790,801 | 2/1974 | Coleman | 250/453 |
| 3,807,052 | 4/1974 | Troue | 34/1 |

*Primary Examiner*—Carroll B. Dority, Jr.
*Assistant Examiner*—Larry I. Schwartz
*Attorney, Agent, or Firm*—Dominic J. Terminello

[57] ABSTRACT

The method for inerting the surface of a moving product involves; passing a stream of inert gas, having a width at least equal to the width of the product, into an enclosure through which the product is to pass and in the direction of the product so as to impinge upon the product surface at a predetermined angle with respect thereto and having a velocity component in a direction opposing the advancing product and a magnitude at least substantially equal to the velocity of the product.

10 Claims, 3 Drawing Figures

FIG. 1
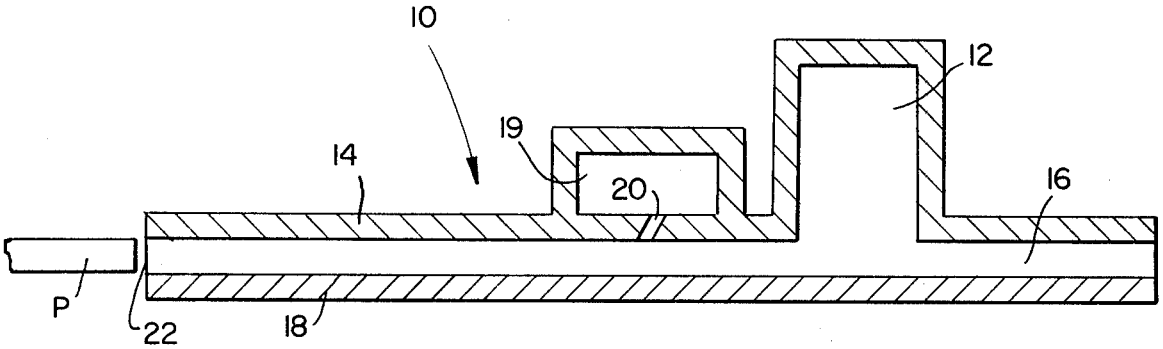
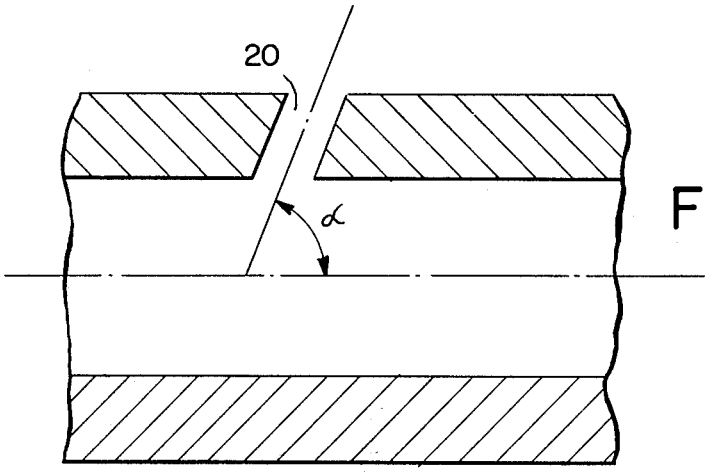
FIG. 2
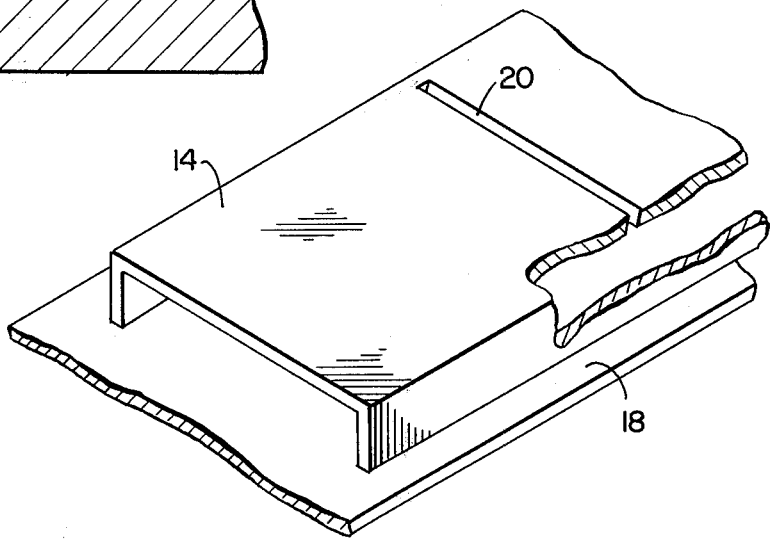
FIG. 3

METHOD OF INERTING THE ATMOSPHERE ABOVE A MOVING PRODUCT

This invention relates to an improved method for inerting the surface of a cross-linkable polymeric product while the product is in motion.

A system for maintaining a gaseous inert atmosphere above a product as the product is moved through a work zone where it is subjected to treatment by exposure to radiant energy, is disclosed in pending U.S. Pat. application Ser. No. 266,121 entitled Apparatus for Irradiation of a Moving Product in an Inert Atmosphere and filed in the name of H. Troue now U.S. Pat. No. 3,807,052 issued Apr. 30, 1974. A fundamental distinction is revealed in the above patent between that of a static system wherein the product remains stationary during treatment and that of a dynamic system wherein the product is in motion during treatment. To accomplish effecting inerting in a dynamic system, the inerting procedure must account for the air lying immediately above the product which, as the product moves, tends to be drawn with the product and along its surface. Hence, simply purging the work zone, although effective in a static system, is entirely inadequate and unsuitable for the dynamic system.

Common to the dynamic inerting system disclosed in the above cited patent application and to the present invention is an enclosure including a treating chamber, which houses the source of radiant energy, an entrance tunnel leading to the treating chamber and adapted to receive the product, and an exit tunnel extending rearward from the treating chamber. Likewise, the design of the inerting system to be disclosed herein adheres to the principles of the cited patent application concerning the relevance of the inerting geometry to the dynamic system although directed to an improved method of passing the inert gas into the enclosure. The means for injecting the inert gas must take such form as to provide a substantially unidirectional curtain or stream of inert gas having a width at least equal to the width of the moving product and must be so oriented as to direct the stream of gas toward the moving product so that the stream intersects with the surface of the product at a predetermined angle of inclination and with a component of velocity opposed to the moving product. An elongated channel or slot formed in the tunnel surface wall, as is shown in the aforementioned patent application, represents the preferred inert gas injector means.

Heretofore it was necessary for the enclosure exit tunnel to have a length substantially greater than the entrance tunnel length. In this manner the majority of the inerting gas was forced to flow out the entrance tunnel. This method of controlling gas flow direction proved to be satisfactory at low and moderate product line speeds of less than 200 feet per min. However, at higher line speeds, of over 200 feet per minute and up to about 1000 feet per minute, the length of the exit tunnel becomes, from a practical standpoint, prohibitive. It has now been discovered that the length of the exit tunnel can be significantly reduced and in fact rendered essentially independent of the length of the entrance tunnel provided that:

(1) the inert gas stream is fed into the enclosure at an included angle of above about 45° but below about 85° with respect to the longitudinal axis of the enclosure, said angle oriented such that the issuing gas stream has a velocity component in a direction opposed to the direction of the moving product;

(2) the inert gas flow rate exiting from the entrance and exit tunnel respectively is held to below a critical volumetric flow level per unit of tunnel width for each specific inert gas composition; and (3) the inert gas velocity component opposing the moving product has a magnitude substantially equal to and preferably greater than the velocity of the moving product.

The specification of any given production line facility and tunnel design parameters outlined in the previously cited patent may then govern the total enclosure design length with the inert gas injector inclination angle and flow rate chosen to satisfy the hereinabove stated conditions. Moreover, by satisfying the above stated conditions, occasional instability in the direction of inert gas flow within the enclosure, which has been noted to occur particularly at higher operating speeds, has been eliminated.

It has been further demonstrated that, provided the above noted conditions are satisfied, the stream of inert gas can be introduced into the enclosure either upstream of the treating chamber as is shown in the aforementioned patent application or, if desired, downstream of the treating chamber. The latter arrangement has been found to be particularly advantageous in applications where the product consists of a plurality of entities each of finite length and where the product thickness varies over at least about one-quarter inch in depth.

Accordingly, it is the principal object of the present invention to provide a method for maintaining a substantially inert atmosphere at the surface of a moving product as it moves through the interior of an enclosure.

It is a further object of this invention to provide a method of inerting the surface of a moving product at product travel speeds of up to about 1000 feet per min. and regardless of whether the product is of a continuous length or represents one of a plurality of entities each of finite length and thickness.

Other objects and advantages will become apparent from the following detailed description when taken in connection with the accompanying drawings of which:

FIG. 1 is a diagrammatic illustration in longitudinal section of a treatment enclosure for irradiating a moving product in an atmosphere to be controlled in accordance with the teachings of the present invention;

FIG. 2 is an exploded view of the inert gas injector showing the preferred angle of inclination for the injector relative to the longitudinal axis of the enclosure;

FIG. 3 is an illustrative isometric of a portion of either tunnel of the enclosure of FIG. 1 in which the inert gas injector is located with a section thereof cut-away to illustrate the lateral orientation of the inert gas injector relative to the width of either tunnel respectively.

Referring to FIGS. 1–3 inclusive in which the treatment enclosure 10, for irradiating the moving product P, is diagrammatically illustrated and comprises a treating chamber 12 which houses a source of radiant energy (not shown); an entrance or inlet tunnel 14 located upstream of the treating chamber 12 in the direction of the moving product P; and an exit tunnel 16 extending downstream of the treating chamber 12. The term "tunnel" for purposes of the present disclosure is defined as a hollow passageway of uniform cross-section which may either have a self-enclosed periphery or a partially enclosed periphery which becomes substantially fully enclosed when the moving product P is present and which preferably conforms to the design parameters outlined in the aforementioned patent application. For simplicity of illustration, the medium 18, which may represent, for example, a conveyor belt surface for advancing the product P through the enclosure 10, is shown forming the physical bottom of the enclosure 10. It should be understood, however, that the bottom of the enclosure 10 may be formed in any manner and is, in fact, preferably established by the moving product itself where the product is continuous.

The product P may represent a chemical coating or a coated substrate and may be of a continuous length such as a web or of a finite length. In the latter instance the product P would actually be presented to the enclosure for treatment as a series of abutting or spaced entities. For purposes of the present invention any source of radiation may be employed to treat the product P within the treating chamber 12 of the enclosure 10 although an internally cooled or non-cooled source is preferred. Preferred sources of actinic radiation are low pressure ultraviolet mercury tubes and/or germicidal lamps as disclosed in patent application Ser. No. 266,122 filed on June 26, 1972 in the names of C. L. Osborn and H. H. Troue and entitled "Process" now U.S. Pat. No. 3,840,448 issued Oct. 8, 1974. as well as conventional medium pressure mercury tubes.

Inert gas G is supplied from an inert gas plenum chamber 19 and passed through an inert gas injector 20 into the enclosure 10. The source of supply for delivering the gas to the plenum chamber 19 is not shown. The inert gas injector 20 is oriented with respect to the longitudinal axis of the enclosure so that its shorter axis intersects with the longitudinal axis forming the acute angle "$\alpha$" as shown in FIG. 2. Angle $\alpha$ is defined as the angle formed between the stream of inert gas G, issuing from the gas injector 20, and the longitudinal axis of the enclosure 10 along which the product P is intended to travel and should lie within a range of above about 45° but below about 85° and be oriented within such range such that the gas stream has a velocity component in a direction opposing the moving product and of a magnitude at least about equal to the velocity of the product. The gas injector 20 may be fabricated by forming a slot in the top surface of the enclosure 10, as shown in FIGS. 1 and 3 respectively. The longer or longitudinal axis of the gas injector 20 should lie substantially parallel to the width of either tunnel 14 and 16 respectively as is shown in FIG. 3.

In the aforementioned U.S. patent application Ser. No. 266,121 it has been taught that dynamic inerting requires a non-turbulent non-mixing inert gas flow within the interior of the enclosure 10. It has now been discovered that the required non-turbulent non-mixing flow within the enclosure 10 is assured regardless of product speeds up to about 1000 feet per min. by the combination of: introducing inert gas into the enclosure 10 in the form of a substantially unidirectional stream; appropriately directing the inert gas stream toward the advancing product P at the preferred angle $\alpha$; and maintaining an inert gas volumetric flow per unit of tunnel width, which is limited, for each inert gas composition, to a maximum level out of each tunnel 14 and 16 respectively. For an inert gas of substantially nitrogen the volumetric flow per unit of tunnel width out from each tunnel 14 and 16 respectively must be below about 650 cu.ft./hr. per foot of tunnel width. For helium the maximum level is about 5000 cu.ft./hr. per foot of tunnel width and for carbon dioxide the maximum level is about 360 cu.ft./hr. per foot of tunnel width. The above levels were determined mathematically and confirmed experimentally. It should be noted that the above levels are independent of tunnel height and independent of product speed at least up to about 1000 feet per min.

Moreover, it has further been discovered that substantially all of the air carried with the advancing product P, upon approaching the inlet opening 22 of the enclosure 10, may be stripped off the product surface and diverted away from the enclosure 10 provided that; the inert gas velocity component, in the direction opposing the moving product P, has a magnitude substantially equal to or greater than the velocity of the moving product P. This is based upon a study made of the atmosphere within the enclosure 10. Measurements of the oxygen levels within the enclosure 10 have shown levels of 50 to 100 ppm and generally less than 500 ppm under typical operating conditions at line speeds in the range of about 300 to about 1000 feet per minute.

As previously stated, the inclined position of the inert gas injector 20 provides a preferential direction for the inert gas flow toward the upstream end of the enclosure 10. This preference has been shown to exist not only when the injector is located in the forward tunnel 14 but also when located in the exit tunnel 16. The latter arrangement wherein the inert gas is fed into the enclosure 10 through the rear tunnel 16 is taught in a corresponding U.S. application Ser. No. 461,393 filed concurrently now abandoned herewith in the name of Donald W. Hunter and entitled Method For Inerting The Atmosphere Above A Moving Product. It is taught in the corresponding application that the injector can be as equally effective when located in the exit tunnel 16 as it is when positioned in the entrance tunnel 14 but not necessarily at the same angle of inclination. Moreover, although the entrance tunnel 14 should still have a length which extends, as is taught in the aforementioned patent U.S. Ser. No. 266,121 now U.S. Pat. No. 3,807,052, from the inlet 22 downstream to the injector 20 a distance equal to at least ten times the smallest cross-sectional dimension of the tunnel opening; the length of the exit tunnel 16 no longer must bear any relationship to the length of the entrance tunnel 14.

The faster the product travels through the enclosure 10 the more the injector should depart from a vertical position, i.e., the angle of inclination $\alpha$ should become smaller. An angle $\alpha$ of below about 45 degrees, however, significantly raises the danger of establishing a venturi effect at the rear of the enclosure causing air to be drawn into the enclosure 10 through the exit tunnel 16. The preferred angle for speeds above 200 feet per minute is about 60°.

For a slower moving product below 200 feet per min. and particularly a discontinuous product, it is more desirable to operate at a higher angle of inclination limited however to below about 85°, preferably at about 75°. At this angle any slight perturbation in flow which might develop due to a thickness variation in product P of greater than one-quarter inch or due to a sudden change in product speed will not upset the preferential flow condition out of the entrance tunnel 14.

Although the method of the present invention has been described with reference to a single injector 20, it is obvious that a tandem combination of injectors may be used provided that the stipulated conditions of, maximum volumetric flow, total velocity component opposing the moving product and range of inclination angle be observed. In the latter respect, it is also apparent that the injector 20 need not be fabricated so as to be stationary in orientation. Instead, an adjustable injector means may be employed for affixing any desired angular orientation within the prescribed range. It should be further understood that it will be apparent to one of ordinary skill in the art to suggest minor variations and modifications without departing from the scope and spirit of the invention as is hereby claimed.

What is claimed is:

1. A method of maintaining a substantially inert atmosphere over the treatable surface of a product which is to be subjected to irradiation while moving at a given speed of up to about 1000 feet per minute through the interior of an enclosure having a treating chamber and a first and second tunnel with the first tunnel located upstream of said chamber relative to said moving product and the second tunnel located downstream of said chamber; said method comprising the steps of:

a. forming a unidirectional stream of inert gas having a width at least about equal to the width of said moving product;

b. passing said unidirectional stream of inert so that the entire flow of inert gas supplied into said enclosure enters said treatable surface and forms an acute angle with respect thereto within a range of from above about 45° to below about 85°; and c. selecting said acute angle such that a major portion of said gas stream is caused to flow in a direction opposed to the advancing product and with a magnitude above the velocity of the moving and having a minor portion caused to flow in the direction with the moving product whereby said major portion of said gas stream, sweeps over the treatable surface of the advancing product so as to prevent air from being drawn into either end of the enclosure.

2. A method as defined in claim 1 wherein said treating chamber houses a source of actinic radiation consisting of at least one ultraviolet radiating lamp.

3. A method as defined in claim 2 wherein said inert gas is nitrogen and further comprising the step of passing said nitrogen stream at a flow rate such that the maximum volumetric flow out of each tunnel respectively is below about 650 cu.ft./hr. per foot of tunnel width.

4. A method as defined in claim 3 wherein said stream of nitrogen is introduced into the enclosure upstream of said treating chamber.

5. A method as defined in claim 4 wherein when said product is moving at a speed of less than 200 feet per minute orienting said angle at about 75°.

6. A method as defined in claim 4 wherein when said product is moving at a speed of above about 200 feet per minute orienting said angle at about 60°.

7. A method as defined in claim 2 wherein said inert gas is helium and further comprising the step of passing said helium stream at a flow rate such that the maximum volumetric flow out of each tunnel respectively is below about 5000 cu.ft./hr. per foot of tunnel width.

8. A method as defined in claim 7 wherein said stream of helium is introduced into the enclosure upstream of said treating chamber.

9. A method as defined in claim 2 wherein said inert gas is carbon dioxide and further comprising the step of passing said carbon dioxide stream at a flow rate such that the maximum volumetric flow out of each tunnel respectively is below about 360 cu.ft./hr. per foot of tunnel width.

10. A method as defined in claim 9 wherein said stream of carbon dioxide is introduced into the enclosure upstream of said treating chamber.

* * * * *

UNITED STATES PATENT OFFICE
CERTIFICATE OF CORRECTION

Patent No. 3,936,950 Issue Date February 10, 1976

Inventor(s) Harden Henry Troue

It is certified that error appears in the above-identified patent and that said Letters Patent are hereby corrected as shown below:

Column 5, line 27 - Claim 1 (b) After "inert" should read

-- gas into one of said tunnels -- line 29 - Claim 1 (b) After "enters" should read

-- in a direction to intersect --

Column 5, line 35 - Claim 1 (c) After "moving" should read

-- product --

Signed and Sealed this

Sixth Day of July 1976

[SEAL]

*Attest:*

RUTH C. MASON
*Attesting Officer*

C. MARSHALL DANN
*Commissioner of Patents and Trademarks*